US005909984A

United States Patent [19]

Matthews

[11] Patent Number: 5,909,984

[45] Date of Patent: Jun. 8, 1999

[54] PILE FORMING SYSTEM AND METHOD OF USING THE SAME

[76] Inventor: Mike R. Matthews, 1402 Valley Landing, Katy, Tex. 77470

[21] Appl. No.: 08/806,037

[22] Filed: Feb. 15, 1997

[51] Int. Cl.[6] ..... E02D 5/30; E04G 13/02

[52] U.S. Cl. ..... 405/257; 405/256; 249/48; 249/110; 249/160

[58] Field of Search ..... 405/231–233, 405/239, 249, 251, 253, 257; 249/10, 48, 50, 51, 110, 122, 125, 134, 135, 142, 160, 187, 188

[56] References Cited

U.S. PATENT DOCUMENTS

| | | | |
|---|---|---|---|
| 786,305 | 4/1905 | McIntyre | 249/11 |
| 1,413,705 | 4/1922 | Brynoldt | 405/116 |
| 1,458,551 | 6/1923 | Seat | 249/99 |
| 1,565,845 | 12/1925 | Brynoldt | 405/114 |
| 1,615,069 | 1/1927 | Brynoldt | 405/223 |
| 1,620,514 | 3/1927 | Brynoldt | 405/116 |
| 1,954,070 | 4/1934 | Cook | 405/254 |
| 2,857,647 | 10/1958 | Williams | 249/10 |
| 2,902,743 | 9/1959 | King | 249/10 |
| 2,940,152 | 6/1960 | Riehl | 249/188 |
| 2,948,042 | 8/1960 | Sylvester | 425/84 |
| 3,071,837 | 1/1963 | Cerutti | 249/10 |
| 3,193,242 | 7/1965 | Tumey et al. | 249/188 |
| 3,582,034 | 6/1971 | Tsuzuki | 249/10 |
| 4,418,884 | 12/1983 | Schimmel | 249/11 |
| 5,066,548 | 11/1991 | Quantin et al. | 428/629 |
| 5,509,759 | 4/1996 | Keesling | 405/232 |

*Primary Examiner*—Tamara Graysay
*Assistant Examiner*—Tara L. Mayo
*Attorney, Agent, or Firm*—Patterson & Associates

[57] ABSTRACT

A pile forming system and method for forming a pile. The pile forming system comprises a top pile forming member, a bottom pile forming member, and an end plate assembled together to provide a complete pile form which can then be filled with concrete to form the pile. Additionally, the pile forming system incorporates a tip forming member which can be secured to one end of the pile form to form a sharp tip at one end of the pile facilitating driving the pile into a subsurface. Additional pairs of top and bottom pile forming members may be joined end to end to form longer piles. After the desired pile form is assembled, concrete is poured or pumped into the pile form through openings on the top surface of the pile form. Preferably, reinforcement bars or rebars which are coated with a non-permeable coating to prevent rust are placed in the pile form before the pouring of the concrete. Pipes or tube inserts are also preferably inserted through opposite side openings on the pile forming members to serves as blockouts for various attachments. After the concrete cures, the forms are disassembled and the resulting pile released from the forming members.

19 Claims, 2 Drawing Sheets

PILE FORMING SYSTEM AND METHOD OF USING THE SAME

FIELD OF THE INVENTION

The present invention relates generally to the formation of concrete piles for various construction purposes. More particularly, the invention relates to a system of components for forming concrete piles and a method for their use.

BACKGROUND OF THE INVENTION

In the construction industry, piles are generally driven into earth, rock or the bed of a lake, river or ocean, to provide load bearing support for structures to be constructed thereon. Piles, generally provided in simple and economical shapes, typically comprise elongated, rigid, straight members having any suitable cross sections including circular, rectangular, hexagonal, octagonal, or I-shaped cross sections. Pilings may be constructed of various material suitable for their use including wood, metals, or hardened compositions such as concrete. Wood piles are subject to destruction by various causes, especially in a marine environment where water and marine life are particularly destructive. Metal piles suffer similar problems in a marine environment. Concrete piles are less destructible and more adaptable to many conditions.

However, since concrete piles are typically reinforced or prestressed by metal rebar, in a marine environment, metal rebars inside concrete piles still rust and eventually cause cracking of concrete piles. Thus, there still exists a need for a reinforced concrete pile having a long life without cracking due to rust of the rebar. It would be desirable if this pile could be formed in various lengths and shapes. It would be further desirable if the pile could be formed by a pile forming system that is re-usable and interchangeable to form piles for various construction purposes.

The present invention provides a pile forming system for pre-cast piles, and more particularly pre-cast piles having reinforcement or rebar. Piles made by this invention may be used in various construction projects, including marine projects such as boat lifts or bulkheads.

SUMMARY OF THE INVENTION

The present invention provides a concrete pile forming system and method for forming a pile. The pile forming system comprises a top pile forming member, a bottom pile forming member, and an end plate assembled together to provide a complete pile form which can then be filled with concrete to form the pile. Additionally, the pile forming system incorporates a tip forming member which can be secured to one end of the pile form to form a sharp tip facilitating driving the pile into a subsurface. Additional pairs of top and bottom pile forming members may be joined end to end to form longer piles. In another aspect of the invention, the pile forming system incorporates of a three-sided pile forming member having an open top instead of a pair of top and bottom pile forming members.

After the desired pile form is assembled, concrete is poured or pumped into the pile form through an opening on the top surface of the pile form. Preferably, reinforcement bars or rebars which are coated with a non-permeable coating to prevent rust are placed in the pile form before the pouring of the concrete. Pipes or tube inserts are also preferably inserted through opposite side openings on the forming members to serves as blockouts for various attachments. After the concrete cures, the forms are disassembled and the resulting pile released from the forming members.

One advantage of the present invention is that the pile forming members may be re-used interchangeably to produce piles for various jobs or to produce piles of various length. Another advantage of the present invention is the long lifetime of the reinforced concrete piles having rebar coated with a non-permeable coating preventing rusting and cracking of the concrete pile.

BRIEF DESCRIPTION OF THE DRAWINGS

So that the above recited features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention provides a concrete pile forming system and method for forming a pile. The pile forming system comprises a top pile forming member having an opening on a top surface, a bottom pile forming member, and an end plate that can be assembled together to provide a complete pile form which can then be filled with concrete to form the pile. After the desired pile form is assembled, concrete is poured or pumped into the pile form through the opening on the top surface of the pile form. After the concrete cures, the forms are disassembled and the resulting pile released from the forming members. In one aspect of the invention, the top and the bottom pile forms resembles the shape of an angled bar having perpendicular side panels extending a desired length. A particular preferred pile formed in this manner has a length of about 10 feet and an 8 inch by 8 inch square cross section.

Figure 1:
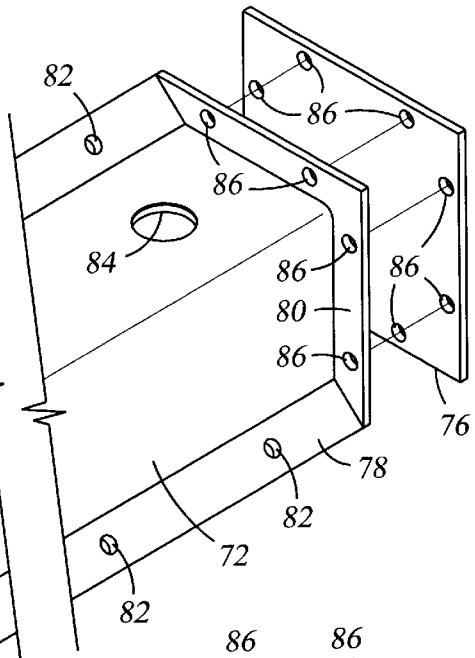
FIG. 1 is an assembly view of a piling form 70 showing two top pile forming members 72, two bottom pile forming members 74 and an end plate 76.

FIG. 1 is an assembly view of a piling form 70 showing two top pile forming members 72, two bottom pile forming members 74 and an end plate 76. In one preferred embodiment of the piling form, the top pile forming member 72 and the bottom pile form member 74 are generally identical, each pile forming member generally resembling an angled bar, preferably having a combined length of about 10 feet and having each side panel about 8 inches wide. The top and bottom pile forming members are releasably coupled, preferably by having side flanges 78 along the length of their sides and end connecting flanges 80 at their ends. The top pile forming member 72 is preferably secured to the bottom pile forming member by nuts and bolts through holes 82 along the side flanges 78. The resulting pile form provides a cavity having a rectangular cross section between the top and bottom pile forming members in which concrete is poured or pumped to form a pile. The top pile forming member 72 preferably has openings 84 on its top side which facilitates concrete pouring or pumping. The top pile forming member 72 and the bottom pile forming member 74 preferably have connecting flanges 80 with holes 86 that can interchangeably connect to either an end plate 76, a divider plate 88 (as shown in FIG. 2), a tip forming member 90 (as shown in FIGS. 3*a* and 3*b*) or another pair of pile forming members.

Figure 2:
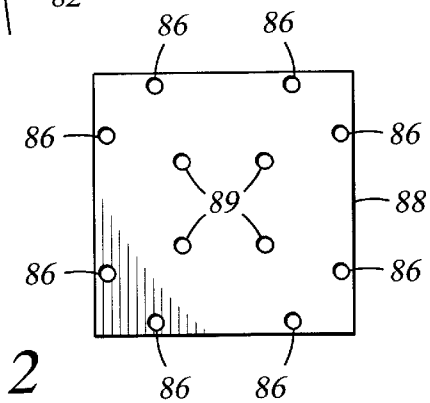
FIG. 2 is a frontal view of a divider plate 88 having holes 86 and rebar holes 89.

FIG. 2 is a frontal view of a divider plate 88 having holes 86 and rebar holes 89. The divider plate is preferably placed between adjoining pairs of top and bottom pile forming members 72,74. In one preferred embodiment, four pieces of rebar, preferably coated with a non-permeable coating to prevent rust or corrosion of the rebar, are placed through the rebar holes 89 and inside the piling form before the concrete is poured or pumped. The rebar serves to provide additional strength to the concrete pile and further provides long life to the concrete pile, especially for under water use of the concrete pile, where the rebar is coated with a non-permeable coating. Rebar encapsulated by a non-permeable coating within concrete piles resist rust or corrosion in underwater pile applications such that they provide long life to the concrete piles because they do not cause cracks in the concrete piles.

Piles of various length can be formed by varying the number of pairs of top and bottom pile forming members. One preferred embodiment uses three pairs of top and bottom pile forming members, each pile forming member being 10 feet long, resulting in a pile 30 feet in length that can be used in conjunction with a bulkhead to form a boat lift. Where a boat lift is to be assembled, long concrete piles are driven into the soil between the opposing bulkhead forming members prior to pouring the bulkhead concrete. The piles are driven into the soil sufficiently deep to become stable but also extend a sufficient height above the top of the bulkhead to mount a boat lift. After pouring a bulkhead around the piles, the result is a boat lift having a plurality of piles extending upward from a bulkhead. In another embodiment, short piles providing additional support for stability for the bulkhead are similarly constructed with the bulkhead.

Figure 3B:
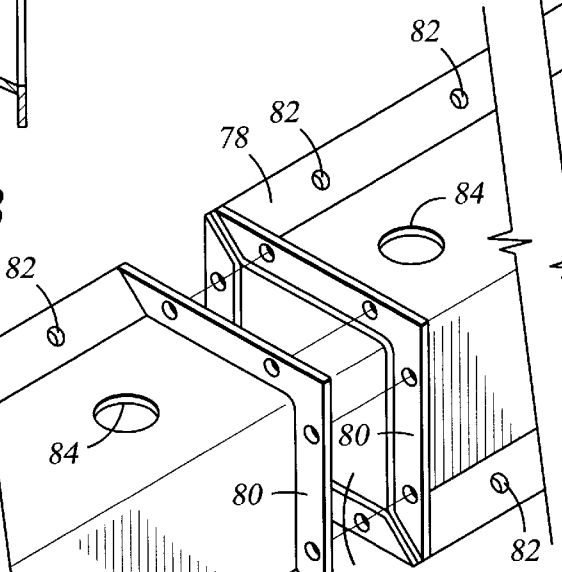
FIGS. 3*a* and 3*b* are frontal and side views of a tip forming member 90.
Figure 3A:
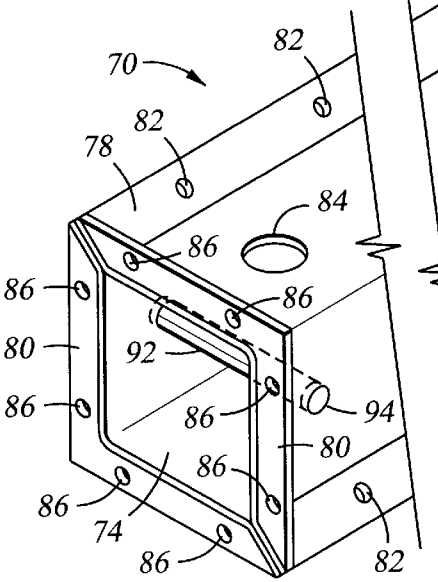
Figure 3A:
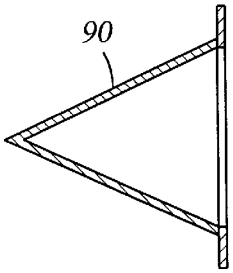
Figure 3A:
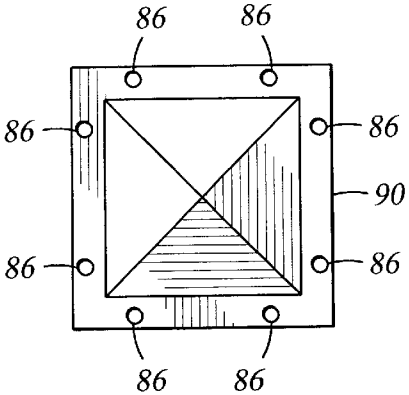

FIGS. 3*a* and 3*b* are frontal and side views of a tip forming member 90. In one preferred embodiment, the pile forming system incorporates a tip forming member 90 which can be secured to one end of the pile form to form a sharp tip facilitating driving the pile into a subsurface. The tip forming member 90 preferably has a hollow pyramid shape with an open-ended base resembling the cross section of the cavity between the top and bottom pile forming members 72,74. The tip-forming member 90 is secured at the open-ended base to an end of the top and bottom pile forming members 72,74 before the pouring of the concrete. In one preferred embodiment, the tip forming member 90 has an 8 inch by 8 inch base with the pyramid extending about 8 inches high.

Referring briefly back to FIG. 1, an assembly view of a pile form 70, a pipe 92 is preferably inserted through opposite side openings 94 on the top and bottom pile forming members 72,74 and releasably secured before the pouring of concrete to provide a blockout for various attachments such as through bolts or connecting rods. In one preferred embodiment, a plurality of pipes 92 are inserted at periodic intervals throughout the pile form.

Figure 4:
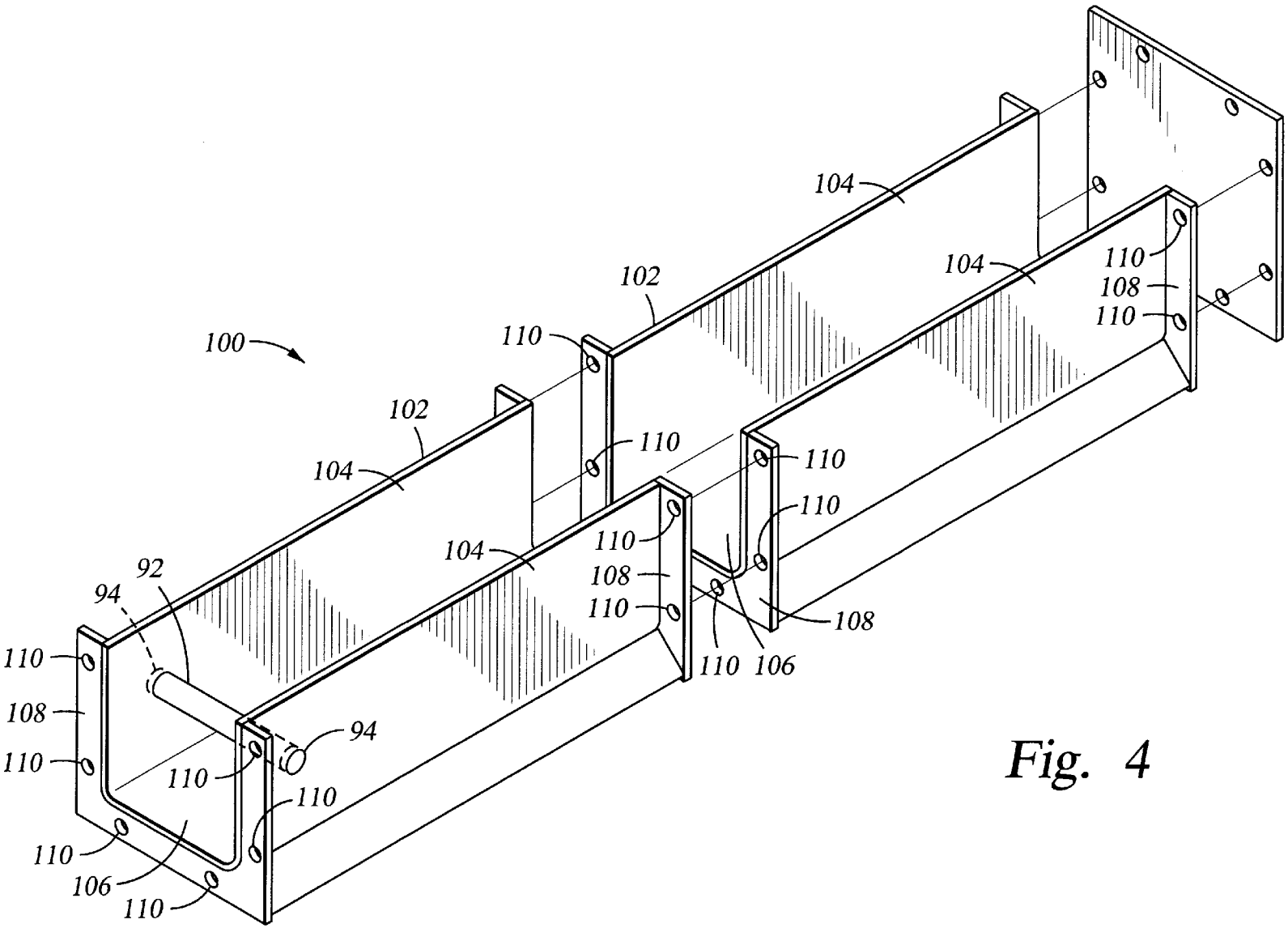
FIG. 4 is an assembly view of a three-sided piling form 100.

FIG. 4 is an assembly view of a three-sided piling form 100 showing two three-sided pile forming members 102 each having two substantially vertical side panels 104 and a base panel 106. Each three-sided pile forming member 102 preferably has end flanges 108 having holes 110 through which a fastener, such as nuts and bolts, can secure adjacent pile forming members 102. Additionally, the end flanges 108 preferably can be adaptably secured to either an end plate 76 (as shown in FIG. 1), a divider plate 88 (as shown in FIG. 2) or a tip forming member 90 (as shown in FIGS. 3*a* and 3*b*). In one preferred embodiment, the three-sided pile forming member preferably has a plurality of pipes 92 at periodic intervals extending between the side panels 104 through opposite side opening 94 releasably secured to the three-sided pile forming member 102 before the pouring of concrete to provide a blockout for various attachments such as through bolts or connecting rods. It should be recognized that the three-sided pile forming members 102 may be formed of a single U-shaped or a combination of members secured together. It may be preferred to use a combination of members, as shown in FIG. 4, to facilitate the release and removal of the concrete pile from the form 100.

While the foregoing is directed to the preferred embodiment of the present invention, other and further embodiments of the invention may be devised without departing from the basic scope thereof, and the scope thereof is determined by the claims which follow.

What is claimed is:

1. A pile form comprising:

a) a bottom pile forming member comprising bottom flanges disposed at each end;

b) a top pile forming member comprising a hole on a top surface and top flanges disposed at each end; the top pile forming member and the bottom pile forming member defining the outer surface of a pile; the top pile forming member and the bottom pile forming members releasably secured to one another such that a cavity having a cross section resembling the cross section of the pile is created between the top pile forming member and the bottom pile forming member; wherein the top and bottom flanges of each end of the pile forming members comprise a first connecting flange disposed at a first end of the pile forming members and a second connecting flange disposed at a second end of the pile forming members; and c) an end plate secured to one of the first or second connecting flanges.

2. The pile form of claim 1, wherein the bottom pile forming member and the top pile forming member have an angled bar shape; the top pile forming member releasably secured to the bottom pile forming member such that the cross section of the cavity is substantially that of a quadrilateral.

3. The method of claim 2 wherein the quadrilateral is a rectangle.

4. The pile form of claim 1 further comprising a tip forming member having a hollow pyramid shape with an open-ended pyramid base resembling the cross section of the cavity; the tip forming member secured at the open-ended pyramid base to a second end of the pair of pile forming members.

5. The pile form of claim 1 wherein the forming members have side flanges disposed along a side of the forming members; the side flanges having holes for fasteners.

6. The pile form of claim 1 wherein the first and second connecting flanges have holes for fasteners.

7. The pile form of claim 1 wherein the top pile forming member has an opening and the bottom pile forming member has a corresponding opposite opening; the pile form further comprising a tube disposed through the openings and releasably secured to the top and bottom pile forming members.

8. A method of forming a pile comprising:

a) releasably securing a bottom pile forming member and a top pile forming member having a hole on a top surface; the top pile forming member and the bottom pile forming member defining the outer surface of a pile; the top pile forming member and the bottom pile forming member defining a cavity resembling the cross section of the pile;

b) releasably securing an end plate to a first end of the pile forming members;

c) pouring at least a cementing material through the hole on the top pile forming member into the cavity; and d) removing the pile forming members after the cementing material cures.

9. The method of claim 8 further comprising placing a rebar between the top and the bottom pile forming members before pouring the cementing material.

10. The method of claim 9 further comprising placing a rebar coated with a non-permeable coating between the top and the bottom pile forming members before pouring the cementing material.

11. The method of claim 8 further comprising releasably securing a tip forming member to a second end of the pile forming members; the tip forming member having a hollow pyramid shape with an open-ended pyramid base resembling the cross section of the cavity.

12. The method of claim 8 further comprising detachably coupling one or more additional pile forming members to a second end of the pair of pile forming members prior to (b).

13. A pile forming system comprising:

a) a three-sided pile forming member; the three-sided pile forming member having a left side panel, a right side panel and a bottom panel connected substantially perpendicularly between the left and right side panels;

b) a first connecting flange disposed at a first end of the three-sided pile forming member and a second connecting flange disposed at a second end of the three-sided pile forming member; and c) an end plate secured to one of the first or second connecting flanges.

14. The pile forming system of claim 13 further comprising a tip forming member having a hollow pyramid shape with an open-ended pyramid base; the tip forming member secured at the open-ended pyramid base to a second end of the three-sided pile forming member.

15. The pile forming system of claim 13 wherein the connecting flanges have holes disposed therethrough for receiving fasteners.

16. The pile forming system of claim 13 further comprising a rebar suspended in a cavity defined by the three-sided pile forming member.

17. A pile form comprising:

a) a bottom pile forming member comprising bottom flanges disposed at each end; and b) a top pile forming member having a hole on a top surface and top flanges disposed at each end; the top pile forming member and the bottom pile forming member defining the outer surface of a pile; the top pile forming member and the bottom pile forming member releasably secured to one another such that a cavity having a cross section resembling the cross section of the pile is defined by the top pile forming member and the bottom pile forming member; and wherein the top and bottom flanges of each end of the pile forming members comprise connecting flange disposed at each end of the pile forming members, wherein the connecting flange are adapted to receive an end plate, a tip forming member, and additional pile forming members connected in series.

18. The pile form of claim 17 wherein the pile forming members are releasably secured to one another by side flanges disposed along a side of the pile forming members.

19. The pile form of claim 17 further comprising an end plate secured to the connecting flanges at at least one end of the pile forming members.

* * * * *